United States Patent [19]

Ota et al.

[11] 4,222,357

[45] Sep. 16, 1980

[54] EXHAUST GAS RECIRCULATION SYSTEM FOR AN INTERNAL COMBUSTION ENGINE

[75] Inventors: Isamu Ota, Toyota; Toshihito Abe, Kariya, both of Japan

[73] Assignees: Toyota Jidosha Kogyo Kabushiki Kaisha, Toyota; Nippondenso Co., Ltd., Kariya, both of Japan

[21] Appl. No.: 962,929

[22] Filed: Nov. 22, 1978

[30] Foreign Application Priority Data

Jul. 12, 1978 [JP] Japan ..... 53-94959[U]

[51] Int. Cl.[2] ..... F02M 25/06

[52] U.S. Cl. ..... 123/568

[58] Field of Search ..... 123/119 A

[56] References Cited

U.S. PATENT DOCUMENTS 4,041,917 8/1977 Suzuki et al. ..... 123/119 A 4,090,482 5/1978 Yoshida ..... 123/119 A 4,092,960 6/1978 Nohira et al. ..... 123/119 A

*Primary Examiner*—Wendell E. Burns

*Attorney, Agent, or Firm*—Kenyon & Kenyon

[57] ABSTRACT

Disclosed herein is a back pressure control type EGR system for an internal combustion engine, wherein a vacuum modulator has an air introducing chamber which is selectively opened, in accordance with the pressure of recirculated exhaust gas, to a vacuum line connecting an EGR port with a vacuum operated flow control valve. The air introducing chamber is further connected to another vacuum port formed slightly above the EGR port via another vacuum line. Switching valve devices responsive to the temperature of the engine are located on the vacuum lines for stopping the EGR operation when the engine is cold.

2 Claims, 2 Drawing Figures

EXHAUST GAS RECIRCULATION SYSTEM FOR AN INTERNAL COMBUSTION ENGINE

DESCRIPTION OF THE INVENTION

The present invention relates to an improvement of the so-called back pressure control type EGR system for an internal combustion engine, which improvement is capable of controlling an EGR ratio in accordance with the load of the engine.

The conventional back pressure control type EGR system is provided with a vacuum-operated flow control valve located on a recirculation passageway connecting an exhaust manifold of the engine with an intake manifold of the engine and with vaccum modulator valve having a control chamber normally opened to the atmosphere. The control chamber is opened, in response to the pressure of the exhaust gas in a small space formed in the recirculation passageway to a vacuum line connecting the flow control chamber with an EGR port formed in an intake passageway of the engine. This system makes it possible to maintain a predetermined constant pressure of the exhaust gas in the constant pressure space, which pressure is near atmospheric air pressure, as is well known to those skilled in this art. Thus, a basic EGR characteristic can be obtained for maintaining a constant ratio of the amount of the recirculated exhaust gas to the total amount of fluid directed to the engine combustion chamber (so-called EGR ratio) every throttle opening or load of the engine.

In order to recirculate a large amount of exhaust gas for obtaining a high EGR effect while preventing the occurrence of an adverse effect such as "surging", an improved back pressure control EGR system is disclosed in the pending Japanese Patent Application No. 53-78575, wherein the control chamber of the modulator valve is connected to a vacuum port which is located slightly above the EGR port. According to such system, a modified EGR characteristic can be obtained when the EGR ratio is increased in accordance with an increase of the load of the engine.

Generally speaking, the EGR operation should be stopped when the engine is cold.

Therefore, the main object of the present invention is to provide, in the improved back pressure control system of the Japanese Patent Application No. 53-78575, a mechanism for stopping the EGR operation when a cold engine is started.

Other objects and advantages of the present invention will be apparent from the following description with reference to the attached drawing in which:

FIG. 1 is a diagrammatic view of an internal combustion engine provided with a back pressure control type EGR system of the present invention; and FIG. 2 is a graph showing the relationships between the throttle opening and the EGR ratio, wherein A indicates a basic EGR characteristic curve of the invention, while the shaded lines indicate a region where "surging" takes place.

DETAILED DESCRIPTION OF PREFERRED EMBODIMENTS

Figure 1:
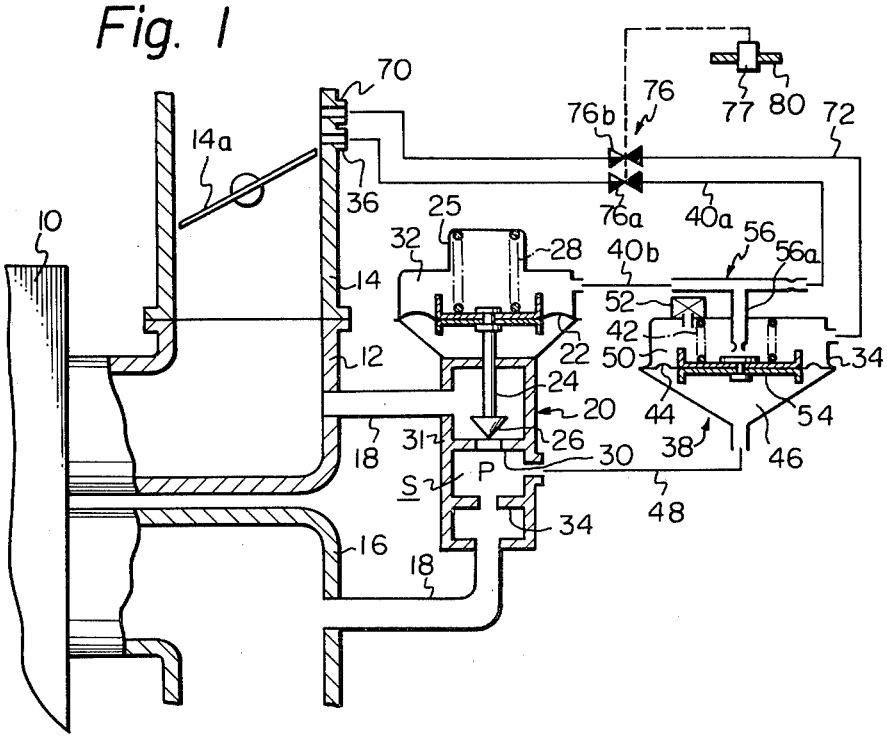

Referring to FIG. 1 which illustrates an embodiment of the present invention, an internal combustion engine comprises an engine body 10, an intake manifold 12 connected to combustion chambers (not shown) in the engine body 10, a carburetor 14 connected to the intake manifold 12 for generating a flow of intake air directed to the combustion chambers, and an exhaust manifold 16 connected to the combustion chambers for receiving resultant exhaust gas therefrom. The reference numeral 18 designates an exhaust gas recirculation (EGR) passageway which connects the exhaust manifold 16 with the intake manifold 12. A flow control valve 20 is adapted for controlling the amount of recirculated exhaust gas passing through the EGR passageway 18 to the intake manifold 12. The flow control valve 20 is of a vacuum operated type and is comprised of a diaphragm 22, a valve rod 24 having one end connected to the diaphragm 22 arranged across the interior of a diaphragm casing 25, and a valve member 26 connected to the other end of the valve rod 24. The flow control valve 20 further comprises a spring 28 and a valve seat 30 formed in a valve casing 31. The spring 28 urges the diaphragm 22, so that the valve member 26 is moved toward a valve seat 30. A vacuum chamber 32 is formed above the diaphragm 22, so that vacuum pressure in the chamber 32 can control the opening between the valve member 26 and the valve seat 30, in order to control the amount of recirculated exhaust gas.

A back pressure control throttle 34 is located slightly below or upstream of the valve seat 30 for restricting the flow area of recirculated exhaust gas directed to the valve seat 30. Therefore, a constant pressure chamber S of a relatively small volume is formed between the valve seat 30 and the throttle 34.

Reference numeral 36 designates a vacuum signal port (so-called EGR port) formed in the carburetor barrel at a position located slightly above the throttle valve **14*a* when the throttle valve 14*a* is in its idle condition. The vacuum actuated flow control valve 20 is operated by vacuum pressure at the EGR port 36** as will be fully described later.

A back pressure control type EGR system of the present invention is provided with, in addition to the flow control valve 20, a modulator valve 38 for controlling the level of the vacuum in the chamber 32 of the valve 20 in accordance with the positive pressure of the recirculated exhaust gas in the constant pressure chamber S. The modulator valve 38 is provided with a diaphragm 44 arranged across the interior of a casing 43. A spring 42 urges the diaphragm 44 to move it downwardly. A back pressure chamber 46 is formed on one side of the diaphragm 44 opposite to the spring 42, which chamber 46 is connected to the constant pressure space S by means of an exhaust gas pressure conduit 48. An air chamber 50, in which the spring 42 is arranged, is opened to the atmosphere through a filter element 52. A valve member 54 is fixed to the diaphragm 44 at the middle portion thereof. Reference numeral 56 designates a vacuum control pipe which is located between a vacuum conduit **40*a* connected to the EGR port 36 and another vacuum conduit 40*b* connected to the chamber 32, and which has a branch portion 50*a* having an open end at the bottom thereof, which end faces the valve plate 54**.

Reference numeral 70 designates a second vacuum signal port 70 formed in the carburetor 14 at a position slightly above the EGR port 36 for generating a vacuum signal with a level which changes in accordance with the load of the engine. The second vacuum port 70 is connected to the air chamber 50 of the vacuum modulator valve 38 by means of a vacuum conduit 72.

The above-mentioned improved back pressure control EGR system is further provided with a switching valve 76 which is responsive to the temperature of the engine, for stopping the EGR operation when a cold engine is started. The switching valve 76 has two valve units 76*a* and 76*b*. The first valve unit 76*a* is mounted on the vacuum conduit 40*a* connecting the vacuum control pipe 56 of the modulator valve 38 with the EGR port 36, while the second valve unit 76*b* is mounted on the vacuum conduit 72 connecting the chamber 50 of the modulator valve 38 with the second vacuum port 70. The switching valve 76 is further provided with a sensing and actuating element 77 arranged in a position of the engine for detecting the temperature of the engine. The element 77 may be attached to a water jacket 80 of the engine body so that the element 77 can contact the cooling water in the water jacket 80. The valve units 76*a* and 76*b* are both operated by the sensing element 77 so that each of them can be switched between an open condition and a closed condition.

The back pressure control EGR system of the present invention operates as follows.

When a cold engine is started, the temperature of the cooling water in the jacket is low. In this case, the sensing and actuating element 77 operates the first valve unit 76*a* and the second valve unit 76*b* so that each is in its closed condition. Thus, the EGR port 36 is disconnected from the control pipe 56 of the modulator valve 38, while the second vacuum signal port 70 is disconnected from the chamber 50 of the modulator valve 38. Therefore, a vacuum signal cannot be transmitted into the EGR system, thus preventing an EGR operation from being carried out.

When the engine is fully warmed up, the temperature of the cooling water in the jacket 80 is high. In this case, the sensing and actuating element 77 causes each of the valve units 76*a* and 76*b* to be switched from the closed condition to the open condition. Therefore, the EGR port 36 is connected to the control pipe 56 while the second port 70 is connected to the chamber 50. Therefore, transmission of a vacuum signal into the EGR system can now be performed. As a result, an EGR operation as described hereinafter can be carried out.

Figure 2:
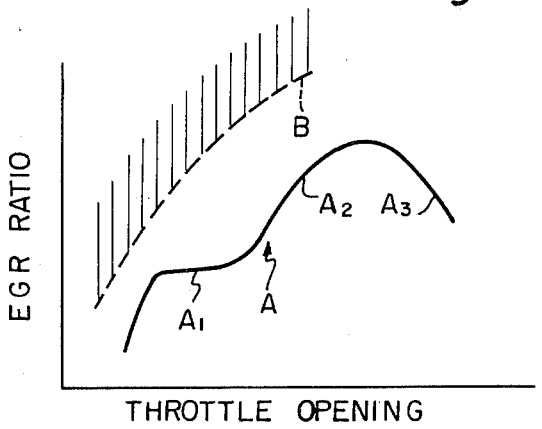

When the throttle valve 14*a* is located below the second vacuum signal port 70, the engine is operating under a low load condition. In this case, the second port 70 is under a pressure which is close to atmosperic pressure, while the EGR port 36 is under a vacuum pressure. Therefore, a vacuum signal at the EGR port 36 is transmitted into the modulator valve 38 via the vacuum conduit 40*a* and is then introduced into the EGR valve 20 via the vacuum conduit 40*b*, in order to generate a vacuum force in the diaphragm 22. This causes the valve member 26 to move away from the valve seat 30 against the force of the spring 28. As a result, the exhaust gas in the constant pressure space S is directed to the intake manifold 12. In this case, the pressure P of the recirculated exhaust gas in the space S urges the diaphragm 44 so that the valve member 54 is moved toward the open end of the pipe portion 56*a* against the force of the spring 42. Therefore, the chamber 50 opened to the atmosphere via an air filter 52 is selectively disconnected from the vacuum control pipe 56 located between the vacuum conduits 40*a* and 40*b* to control the vacuum level in the chamber 32 of the EGR valve 20, in accordance with an increase in the pressure P of the recirculated exhaust gas, for controlling the opening between the valve member 26 and the valve seat 30. As a result, the pressure P of the recirculated exhaust gas in the space S is substantially maintained at atmospheric pressure. The constant pressure, which is close to atmospheric pressure in the space S, makes it possible to maintain a constant ratio of the amount of the recirculated exhaust gas introduced into the intake manifold 12 to the amount of the total fluid introduced into the engine body 10 (EGR ratio). This phenomenon is well known to those skilled in this art and is illustrated by the curve $A_1$ in FIG. 2 which shows the relation between the load of the engine (opening of the throttle valve 14*a*) and the EGR ratio. In FIG. 2, the curve B indicates the maximum EGR ratio at every throttle opening where "surging" does not take place, while the shaded lines indicate a region where "surging" is generated. Thus, the curve A should be located below the curve B so that a large amount of the exhaust gas is recirculated for effectively decreasing $NO_x$ emmissions from the engine, while preventing the occurrence of "surging".

When the engine is operating under medium load condition, the throttle valve 14*a* is located above the second port 70, so that the pressure of the port 70 is a vacuum pressure. Therefore, even if the chamber 50 is opened to the atmosphere via the air filter 52, the chamber 50 will still remain under a vacuum pressure. Such vacuum pressure in the air chamber 50 causes the diaphragm to be urged upwardly so that the valve member 54 is moved toward the open end of the pipe portion 56*a*. Therefore, the amount of air introduced into the air control pipe 56 from the chamber 50 is decreased, and the vacuum in the vacuum chamber 32 of the EGR valve 20 is thus increased. As a result, because the valve member 26 is moved away from the valve seat 30, the amount of the recirculated exhaust gas flowing via the EGR passageway 18 is increased. Since the vacuum level at the port 70 increases as the throttle opening increases, the vacuum level of the vacuum chamber 32 of the EGR valve, i.e., the EGR ratio, increases in accordance with the increase of the throttle opening, as shown by the curve $A_2$ in FIG. 2.

When the throttle valve 14*a* is further opened, i.e., when the engine is operating under a high load condition, the vacuum level at the load sensing port 70 is high enough to cause the diaphragm 44 to be moved upwardly against the force of the spring 42, so that the valve member 54 is always rested on the open end of the pipe portion 56*a*. Therefore, the air chamber 50 of the modulator valve 38 is always disconnected from the control pipe 56, so that the vacuum modulating function of the valve 38 is stopped. As a result, the EGR ratio is controlled in accordance with the vacuum level at the EGR port 36 to decrease the EGR ratio in accordance with the increase of the throttle opening, i.e., the load of the engine as shown by the curve portion $A_3$ in FIG. 2. This curve $A_3$ is substantially the same as the characteristic curve of the so-called vacuum control type EGR system.

What is claimed is:

1. An exhaust gas recirculation system for an internal combustion engine which has an engine body, an intake device connected to said engine body, a throttle valve arranged in said intake device, and an exhaust device connected to said engine body, said system comprising:

passageway means for connecting the exhaust device with said intake device for recirculating exhaust gas from said exhaust device to said intake device;

flow control valve arranged in said passageway means and having vacuum actuator means for controlling the opening of said valve means;

first vacuum conduit means for connecting said vacuum actuator means with a first vacuum source in said intake device at a position slightly above said throttle valve in its idle condition;

means for forming a space of a predetermined small volume in said passageway means at a position located between said flow control valve means and said exhaust device;

modulator means having a control chamber which is selectively opened to the vacuum conduit means, in accordance with the pressure of the recirculated exhaust gas in said space, for controlling the vacuum level in said vacuum actuator means;

second vacuum conduit means for connecting said control chamber with a second vacuum source in said intake device at a position slightly above said first vacuum source; and vacuum switching valve means responsive to the temperature of said engine for respectively stopping the introduction of a vacuum signal into said vacuum actuator means and said control chamber when the temperature of said engine is in a predetermined range.

2. An exhaust gas recirculation system according to claim 1, wherein said vacuum switching valve means comprises a first valve unit and a second valve unit, one valve unit being arranged on said first vacuum conduit means, the other being arranged on said second vacuum conduit means, said first and second valve units being synchronously operated in response to the temperature of said engine.

* * * * *